United States Patent [19]

Alonas

[11] 3,961,147

[45] June 1, 1976

[54] KEYING CONTACT ASSEMBLY

[75] Inventor: Kay Alonas, Skokie, Ill.

[73] Assignee: Teletype Corporation, Skokie, Ill.

[22] Filed: Apr. 10, 1974

[21] Appl. No.: 459,826

[52] U.S. Cl. ..... 200/159 B
[51] Int. Cl.[2] ..... H01H 3/12
[58] Field of Search ..... 200/159 B, 5 A, 159 R, 200/159 A, 302, 160

[56] References Cited

UNITED STATES PATENTS

| | | | |
|---|---|---|---|
| 3,603,756 | 9/1971 | Carpentier | 200/159 B |
| 3,668,356 | 6/1972 | Kekas | 200/159 B X |
| 3,773,998 | 11/1973 | Seegar et al. | 200/159 B |
| 3,829,632 | 8/1974 | Klehm, Jr. | 200/5 A |

OTHER PUBLICATIONS

Mathewson et al., IBM Tech. Disc. Bull., vol. 15, No. 10, Mar. 1973, pp. 3162–3163.

Jarvis et al., IBM Tech. Disc. Bull., vol. 13, No. 7, Dec. 1970, p. 1755.

*Primary Examiner*—Herman Hohauser
*Attorney, Agent, or Firm*—J. B. Hoofnagle, Jr.; J. L. Landis

[57] ABSTRACT

A keying contact assembly, for providing a valid indication of contact closure after effectuating the closure of a contact pair, includes a resilient bulb coupled to one end thereof adjacent to the contact pair. The resilient bulb has negative force displacement characteristics. Upon actuation of the keying contact assembly, the resilient bulb is moved to engage and close the contact pair. After the contact pair has been closed and a subsequent predetermined key force is reached, the resilient bulb utilizes its negative force displacement characteristics to provide tactile feedback through the keying contact assembly to indicate contact closure. The resilient bulb also damps the closed contact pair to prevent bounce and premature opening of the contact pair.

12 Claims, 4 Drawing Figures

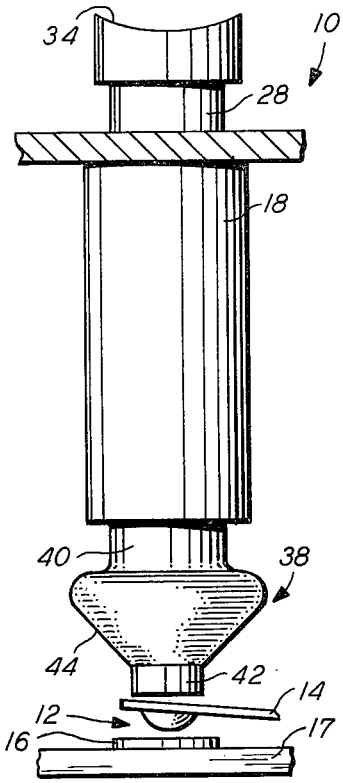
FIG-1
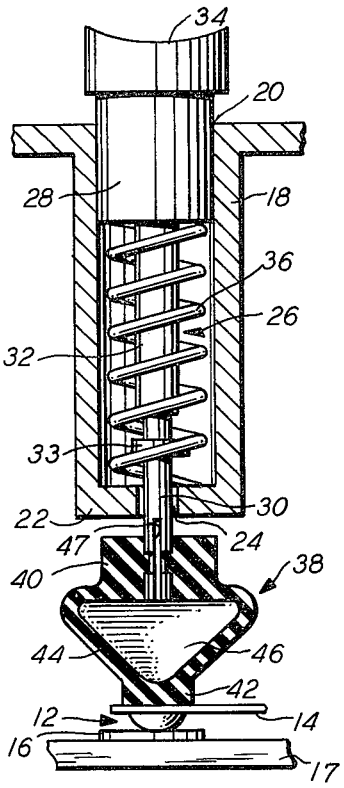
FIG-2
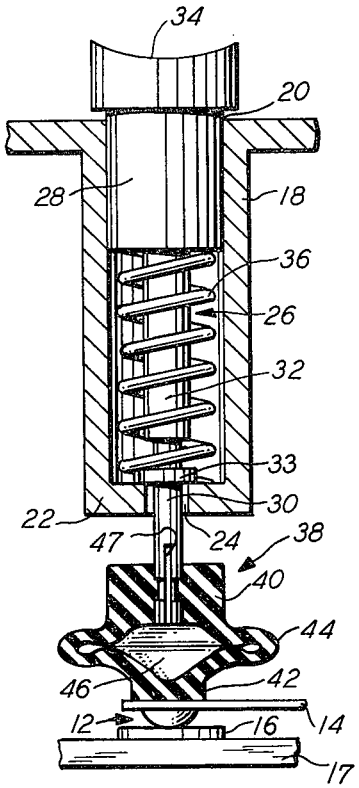
FIG-3
FIG-4
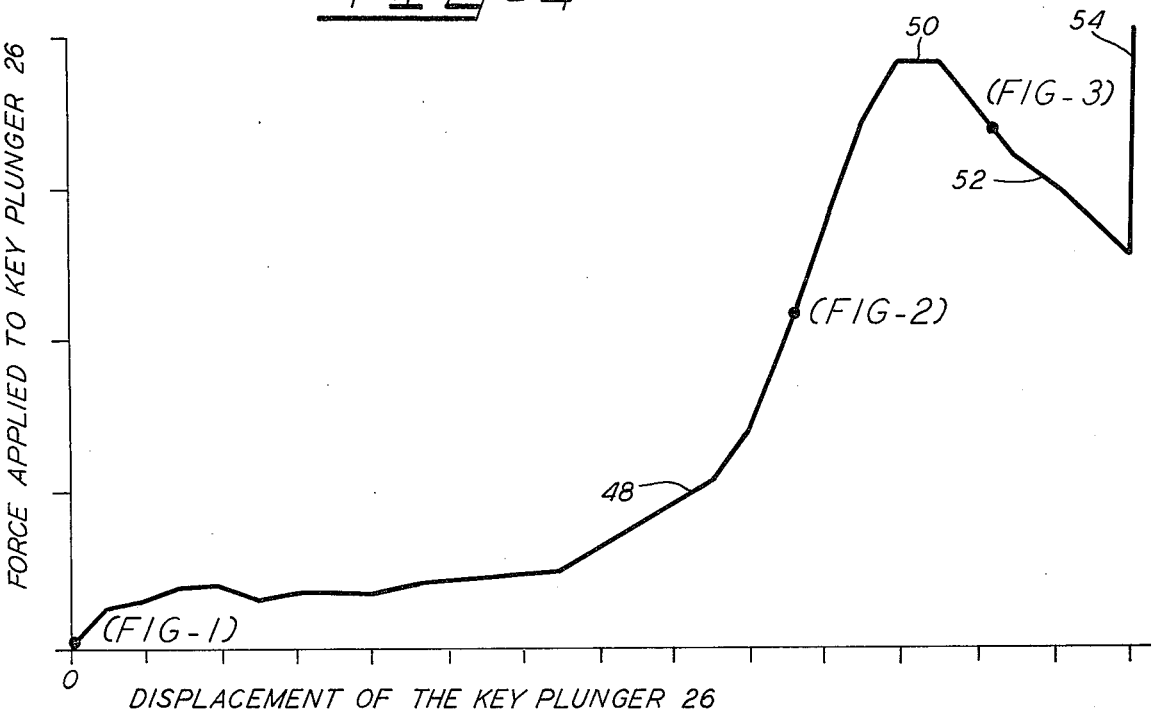

KEYING CONTACT ASSEMBLY

BACKGROUND OF THE INVENTION

1. Field of the Invention

This invention relates to a keying contact assembly and particularly relates to an assembly for initiating character signals in printing operations which institutes a tactile feedback signal after closure of a contact pair so that a valid indication of contact closure is received by an operator while at the same time precluding bounce and premature opening of the contact pair.

2. Discussion of the Prior Art

In keying contact assemblies, it is well known in the art to provide the operator with some desired key touch near the completion of the contact closing operation. Also, it is well known to provide means that will eliminate bounce and premature opening of the contacts. In some prior art arrangements, this is achieved by using at least two individual means, one of which will provide a desired touch to an operator and the other of which will in some way act to damp the contacts and avoid premature opening of the contacts. Examples of such systems are disclosed in U.S. Pat. No. 3,244,847, issued to A. C. Erpel, and U.S. Pat. No. 3,745,536, issued to W. C. Klehm, Jr.

However, systems such as these are expensive because of the necessity of using the plural elements to achieve the aforementioned results. Still further, these systems direct their attention to achieving a confortable key touch for an operator. Consequently, they do not necessarily address themselves to giving a valid indication of contact closure. Therefore, they cannot be relied on for such an indication.

Accordingly, it is desirable to provide a less expensive key contact assembly, which utilizes a single element to provide the desired key touch (tactile feedback) only after the contacts are closed thus assuring a valid indication of contact closure. In addition, it is desired that this single element also act to damp the contacts so that bounce and premature opening of the contacts are precluded.

SUMMARY OF THE INVENTION

It is, therefore, an object of this invention to provide a new and improved keying contact assembly.

Another object of this invention is to provide a new and improved keying contact assembly which provides a substantial amount of tactile feedback to an operator.

Still another object of this invention is to provide a new and improved keying contact assembly which provides a valid indication of contact closure after the contacts have been closed.

A further object of this invention is to provide a new and improved keying contact assembly which precludes contact bounce and premature opening of a contact pair.

A keying contact assembly in accordance with this invention may include a resilient element which resists force being applied to an associated key beyond a force required to engage contacts in a contact pair up to a predetermined force. Upon reaching the predetermined force, the resilient element begins to collapse and the application of forces less than the predetermined force causes the continued collapsing action in the resilient element which provides tactile feedback to an operator indicating that the contacts are closed.

BRIEF DESCRIPTION OF THE DRAWING

Other objects and advantages of the present invention will be apparent from the following detailed description when considered in conjunction with the accompanying drawings in which:

FIG. 1 is a front elevation view showing a keying contact assembly embodying certain principles of the invention;

FIG. 2 is a front elevation cross sectional view showing the keying contact assembly of FIG. 1 as it engages a contact pair;

FIG. 3 is a front elevation cross sectional view showing the keying contact assembly of FIG. 1 illustrating a collapsed resilient bulb of the assembly after contacts of the contact pair are closed; and FIG. 4 is a graph of the force-displacement characteristics of the keying contact assembly of FIG. 1 illustrating positive and negative force displacement characteristics of the resilient bulb.

DETAILED DESCRIPTION

Referring to FIG. 1, a keying contact assembly, designated generally by the numeral 10, is located adjacent to a contact pair, designated generally by the numeral 12, which includes a moveable contact 14 and a stationary contact 16 deposited on a printed-circuit card 17. This arrangement permits the keying contact assembly 10, when operated, to close the contact pair 12 (FIG. 2).

As illustrated in FIG. 2, the keying contact assembly 10 includes a hollow housing 18 which can be mounted to any suitable support (not shown), such as, for example, the keyboard of a printer or which can be an integral part of the keyboard itself. The housing 18 has a substantially open top portion 20 and a substantially closed bottom 22 which has a central opening 24 formed therethrough. A moveable key plunger, designated generally by the numeral 26, includes an enlarged upper end 28, a lower reduced end 30 and an intermediate section 32 therebetween. The intermediate section 32 of the key plunger 26 has an enlarged flange portion 33 formed thereon. The key plunger 26 is slideably retained in the housing 18 with a portion of the end 30 of the key plunger 26 extending through the opening 24 and externally of the housing. The key plunger 26 is keyed in the housing 18 (by a conventional key mounting, not shown) to prevent the plunger from rotating. A key button 34 is coupled to the upper end 28 of the key plunger 26.

A compression spring 36, for normally urging the key plunger 26 in a direction away from the contact pair 12 (FIG. 1), is captured in the housing 18 between the underside of the end 28 of the key plunger 26 and the inner surface of the bottom 22 of the housing, with the spring surrounding the internal portions of the key plunger which includes the intermediate section 32.

A substantially hollow resilient bulb, designated generally by the numeral 38, composed of rubber or some other suitable elastomer, is coupled to the external portion of the lower end 30 of the key plunger 26. With this arrangement, when the appropriate force is applied to the key button 34, the key plunger 26 is moved toward the contact pair 12 subsequently allowing the resilient bulb 38 to engage and close the contact pair.

The resilient bulb 38 includes a generally circular, enlarged upper section 40 and a generally circular, smaller lower section 42 spaced from the upper section. A side wall 44 extends between and is formed integrally with the peripheral portions of the upper and lower sections 40 and 42 wherein a hollow space 46 is formed internally of the upper and lower sections and the side wall. As illustrated, the side wall 44 tapers from the upper section 40 and converges toward the lower section 42 to form the bulb configuration. A longitudinal slot 47 (FIG. 2) is formed in the lower segment of the key plunger 26 which extends into the enlarged upper section 40 of the bulb 38. The longitudinal slot 47 is of sufficient length to allow atmospheric air to flow freely into and out of the bulb 38 so that the bulb can compress and expand accordingly as the contact pair 12 is closed and then reopened.

Because of an inherent quality of the resilient bulb 38, an application of increasing positive force is required to overcome the resistance of the resilient bulb to thereby initiate the collapse of the bulb. This inherent resistance quality of the resilient bulb 38 is representative of the bulb's positive force displacement characteristics. Upon reaching a predetermined positive force that overcomes the resistance of the resilient bulb 38, less force than the predetermined force is thereafter required to collapse the bulb. This latter feature is representative of the negative force displacement characteristics of the resilient bulb 38 and is utilized to provide tactile feedback to an operator after the contact pair 12 has been closed.

When the key plunger 26 is actuated through external force applied to the key button 34, the key plunger is guided in the housing 18 to compress the compression spring 36 as the key plunger moves in the downward direction. After the key plunger 26 has traveled a portion of its total displacement, the resilient bulb 38 engages and moves the moveable contact 14 into contacting engagement with the stationary contact 16 (FIG. 2). Further, application of increasing forces to the key top 34, after the contacts 14 and 16 are closed, are applied to the resilient bulb 38 which tends to resist the increasing forces up to the predetermined force level due to the positive force displacement characteristics of the bulb.

When the predetermined force level is reached, the resistance of the resilient bulb 38 is overcome. This permits the application of key plunger forces which are less than the predetermined force level to cause the initiating of the partial collapsing of the resilient bulb 38. As the resilient bulb 38 collapses, portions of the side wall 44 of the bulb buckle outwardly with inside portions of the side wall ultimately engaging as illustrated in FIG. 3. The collapse of the resilient bulb 38 and the relative ease experienced in accomplishing the collapse, because of the negative force displacement characteristics of the bulb, provides the tactile feedback signal which indicates that the contacts 14 and 16 have been closed.

When the resilient bulb 38 is in the uncollapsed position of FIG. 2 or the collapsed position of FIG. 3, the resiliency of the bulb, because of the bulb's structure and the continued application of force, resists any reactionary forces that are transmitted by the closing of the contact pair 12. Accordingly, the resilient bulb 38 acts to prevent the contact 14 from bouncing thereby precluding any premature opening of the contact pair 12.

The negative force displacement characteristics of the resilient bulb 38 are further explained with reference to a force-displacement curve illustrated in FIG. 4. When the keying contact assembly 10 is not in operation (FIG. 1), the force applied to the key plunger 26 and the displacement of the key plunger which results from the applied force are zero, as is represented in the extreme lower left portion of the curve. As continuously increasing force is applied to the key button 34, the force on the key plunger 26 increases thereby resulting in an increase in displacement of the key plunger. These force and displacement increases are illustrated by line 48 of the curve and, as they occu the key plunger 26 moves toward the contact 14 and subsequently engages and moves the contact 14 into engagement with the contact 16, which is attached to the printed circuit card 17 (FIG. 2). Further depression of the key button 34, after the contact pair 12 has been closed, will result in further increases in force and displacement of the key plunger 26 up to a level 50 of the curve. During the period prior to reaching level 50, and after the contact pair 12 has been closed, the resilient bulb 38 displays its positive force displacement characteristics and resists collapsing.

When the force applied to the key button 34 reaches the force level represented at level 50, the negative force displacement characteristics of the resilient bulb 38 begin to be exhibited whereafter the bulb collapses (FIG. 3) upon further application of forces which are less than those represented at level 50. This phenomenon is illustrated along line 52 of the curve. This, in turn, results in a sudden, noticeable increase in the downward displacement of the key plunger 26 with a corresponding noticeable decrease in the amount of force required to achieve this displacement.

The key plunger 26 ultimately stops, as indicated in FIG. 3, when the flange portion 33 of the key plunger reaches the inner surface of the bottom 22 of the housing 18. This assures that the resilient bulb 38 is not compressed further than is necessary to provide closure of the contacts 12 and to provide a force sufficient to keep the contacts from opening prematurely or bouncing. This effect is shown by the vertical line 54 at the right end of the force-displacement curve of FIG. 4.

Consequently, as a result of this keying contact arrangement, an operator receives a substantial amount of tactile feedback which indicates that the contact pair 12 has been successfully closed.

It is to be understood that the above-described embodiment is simply illustrative of this invention. Other embodiments may be devised by those skilled in the art which will embody the principles of the invention and fall within the spirit and scope thereof.

What is claimed is:

1. A keying contact assembly for moving one contact of a contact pair into engagement with the other contact of the contact pair and for developing a subsequent signal providing valid assurance of closure of the contact pair which comprises:

resilient feedback means aligned to bear directly upon the one contact of the contact pair for forcing the one contact into engagement with the other contact and, subsequent to closure of the contact pair, for exhibiting a negative force displacement characteristic which provides indications of the closure of the contact pair;

moveable means aligned with and spaced from the contact pair and coupled to the resilient feedback means for moving the resilient feedback means to force the one contact into engagement with the other contact; and means for mounting the moveable means for movement toward the contact pair to close the contact pair.

2. A keying contact assembly as defined in claim 1 wherein the resilient feedback means is further for damping the closed contact pair to prevent bounce and premature opening of the contacts.

3. A keying contact assembly as defined in claim 1 further comprising means for allowing air to flow freely into and out of the resilient feedback means so that the resilient feedback means can be properly collapsed subsequent to the closing of the contact pair and properly expanded after the contact pair has been reopened.

4. A keying contact assembly as defined in claim 3 wherein the means for allowing air to flow comprises a slot formed in a segment of the moveable means with at least a portion of the segment being coupled to the resilient feedback means so that a portion of the slot extends along that portion of the segment of the moveable means which is coupled to the resilient feedback means and other portions of the slot extend along portions of the segment externally of the resilient feedback means.

5. A keying contact assembly as defined in claim 1 wherein the resilient feedback means comprises a substantially hollow elastomeric bulb which will begin to collapse when a force applied to the moveable means reaches a predetermined force level which is greater than the force level necessary to close the contact pair.

6. A keying contact assembly as defined in claim 1 wherein the moveable means comprises:

a plunger, and the means for mounting the moveable means comprises, a housing for receiving and containing an intermediate section of the plunger therein with opposite end portions of the plunger protruding externally therefrom, the resilient feedback means coupled to the externally protruding end of the plunger adjacent to the contact pair and the other externally protruding end for permitting the application of external force thereto for moving the plunger within the housing.

7. A keying contact assembly as defined in claim 6 which further comprises a spring captured within the housing for normally urging the plunger in a direction away from the contact pair.

8. A keying contact assembly for closing a contact pair and thereafter providing a valid indication of closure of the contact pair which comprises:

a resilient feedback means aligned to bear directly on the one contact of the contact pair for forcing the contacts of the contact pair into engagement when force is applied to move the resilient feedback means to close the contact pair and for providing a tactile feedback signal indicative of contact closure after the contacts are closed, the resilient feedback means being of such a structure that it will exhibit positive force displacement characteristics as the resilient feedback means is moved in the closing of the contact pair and will continue to exhibit the same characteristics subsequent to contact closure up to the application of a predetermined force where, upon the reaching of the application of the predetermined force, a collapsing action will be initiated in the resilient feedback means which will cause the resilient feedback means to exhibit negative force displacement characteristics and will provide the tactile feedback necessary to indicate that the contact pair is closed;

a moveable means aligned with and spaced from the contact pair and coupled to the resilient feedback means for moving the resilient feedback means to force the one contact into engagement with the other contact; and means for mounting the moveable means for movement toward the contact pair to close the contact pair.

9. A keying contact assembly as defined in claim 8, wherein the resilient feedback means is further for damping the closed contact pair to prevent bounce and premature opening of the contact pair.

10. A keying contact assembly for providing a valid indication of contact closure of a contact pair which comprises:

a housing;

a plunger having intermediate portions disposed within the housing;

the plunger aligned with and spaced from the contact pair so that upon application of an appropriate force the plunger will be guided within the housing to move toward the contact pair;

a compression spring disposed in the housing for normally urging the plunger in a direction away from the contact pair; and a substantially hollow resilient bulb, coupled to the plunger for movement therewith and aligned to bear directly upon the one contact of the contact pair during contact closure, for forcing the one contact into engagement with the other contact when the plunger is moved toward the contact pair and for exhibiting a negative force displacement characteristic to provide a tactile feedback signal after contact closure.

11. A keying contact assembly as defined in claim 10 wherein the resilient bulb comprises:

an enlarged upper portion;

a smaller lower portion spaced from the enlarged upper portion; and a side wall extending between and formed integrally with the upper and lower portions, the side wall being of such structure that, upon application of a predetermined force to the plunger after contact closure has been effected, a collapsing action will be initiated in the resilient bulb, allowing application of forces less than the predetermined force to cause intermediate outer portions of the side wall to buckle thereby resulting in the collapsing of the resilient bulb, the application of forces less than the predetermined force and the collapse of the resilient bulb providing tactile feedback indicative of contact closure of the contact pair.

12. A keying contact assembly as defined in claim 11 wherein the resilient bulb is further for damping the closed contact pair to prevent bounce and premature opening of the contacts.

* * * * *